US005777283A

United States Patent [19]

Greer

[11] Patent Number: 5,777,283

[45] **Date of Patent: *Jul. 7, 1998**

[54] SWITCH MECHANISM AND BASE FOR A DISCONNECT SWITCH

[75] Inventor: David Emerson Greer, Lexington, Ky.

[73] Assignee: Square D Company, Palatine, Ill.

[ * ] Notice: The term of this patent shall not extend beyond the expiration date of Pat. No. 5,609,245.

[21] Appl. No.: 475,264

[22] Filed: Jun. 7, 1995

Related U.S. Application Data

[62] Division of Ser. No. 359,977, Dec. 20, 1994, Pat. No. 5,609,245.

[51] Int. Cl.[6] ..... H01H 9/00; H01H 85/00

[52] U.S. Cl. ..... 200/18; 200/293; 337/186; 361/833

[58] Field of Search ..... 218/149–155; 361/822–824, 833–835; 332/186–216; 200/50.01–50.2, 329–337, 293, 18

[56] References Cited

U.S. PATENT DOCUMENTS

| | | | |
|---|---|---|---|
| 3,114,024 | 12/1963 | Tillson | 200/293 |
| 3,172,984 | 3/1965 | Cellerini et al. | 200/337 |
| 3,684,849 | 8/1972 | Zubaty | 200/554 |
| 3,970,808 | 7/1976 | Gryctko et al. | 200/50.15 |
| 4,013,989 | 3/1977 | Born | 337/186 X |
| 4,302,643 | 11/1981 | Cox et al. | 218/152 |
| 4,395,606 | 7/1983 | Zaffran et al. | 218/149 |
| 4,938,715 | 7/1990 | Jones et al. | 439/621 |
| 5,365,395 | 11/1994 | Callaway | 361/56 |
| 5,426,406 | 6/1995 | Morris et al. | 335/202 |
| 5,434,376 | 7/1995 | Hyatt et al. | 200/293 |
| 5,559,489 | 9/1996 | Weiden | 337/215 |
| 5,609,245 | 3/1997 | Cassity et al. | 200/293 X |

*Primary Examiner*—J. R. Scott

*Attorney, Agent, or Firm*—Larry I. Golden; Kareem M. Irfan

[57] ABSTRACT

The present invention provides a switch mechanism module and a line base module, useable separately or in combination, for an interior assembly of an electrical distribution device having a plurality of modules. The electrical distribution device has an enclosure with a handle external to the enclosure for operator control. The switch mechanism module and line base module include a modular housing having a generally planar base with upstanding side walls around the circumference of the base. The side walls have a top edge defining a mating surface. The modular housing is demountably secured to at least one adjacent module with a manually operated securement which is integrally formed with the modular housing.

20 Claims, 10 Drawing Sheets

SWITCH MECHANISM AND BASE FOR A DISCONNECT SWITCH

This is divisional of application Ser. No. 08/359,977 filed on Dec. 20, 1994, now U.S. Pat. No. 5,609,245.

RELATED APPLICATIONS

The subject matter of this application is related to the subject matter of the following applications, each having the same assignee as the present invention, Square D Company, and each incorporated herein by reference in its entirety:

U.S. application Ser. No. 08/359,977 now U.S. Pat. No. 5,609,245, entitled "MODULAR SWITCH INTERIOR ASSEMBLY AND METHOD OF ASSEMBLING SAME" filed on Dec. 20, 1994 by Terry Cassity, David Emerson Greer, Jeffrey James Buchanan, Steve Miles Ledbetter and Jonathan Hans Van Camp;

U.S. application Ser. No. 08/476952 now U.S. Pat. No. 5,737,195 entitled "NEUTRAL BASE FOR DISCONNECT SWITCH AND METHOD OF ASSEMBLING SAME" filed on even date herewith by David Emerson Greer, Jonathan Hans Van Camp, and Terry Cassity;

U.S. application Ser. No. 08/478,150, now U.S. Pat. No. 5,739,488, entitled "SWITCH MECHANISM HANDLE" filed on even date herewith by Terry Cassity, David Emerson Greer, Jeffrey James Buchanan, and Steve Miles Ledbetter; and U.S. application Ser. No. 08/475,265, now U.S. Pat. No. 5,746,306, entitled "SWITCH HAVING STACKABLE FUSES" filed on even date herewith by David Emerson Greer.

Related U.S. application Ser. No. 08/109,419, filed on Aug. 19, 1993, discloses one class of manual and demountable snap-fit connections suitable for use in the present application. The entire teaching and disclosure of that co-pending application is incorporated herein by reference.

FIELD OF THE INVENTION

The present invention relates to fusible switches, disconnect switches, and the like, which have a modular interior assembly of interchangeable components providing a more compact design.

BACKGROUND OF THE INVENTION

A fusible switch is usually mounted in an enclosure and incorporates an insulating base to carry an incoming line terminal for each phase. The circuit for each phase is completed through a pivotal knife blade which engages a corresponding contact stab and is electrically connected with a fuse clip having a fuse seated therein. In U.S. Pat. No. 4,302,643, commonly assigned to the Square D Company, a fusible switch is shown utilizing the above-mentioned construction and which is hereby incorporated by reference in its entirety.

Fusible switches are used in switchboards to distribute power for commercial and industrial applications. The need arises to distribute more power through enclosures which are the same size or smaller. This requires increasing the electrical rating of the switch to carry a higher voltage and current density while decreasing the size of the enclosure housing the electrical parts.

Among the problems caused by decreasing the space requirements of a switch is the additional hardware necessary for mounting different types and classes of fuses in a fusible switch. Usually, only one class of fuse will fit in a fuse holder. Furthermore, mounting screws are used to attach and retain fuse clips and other terminals to switch base interiors. The need arises to assemble the fuse switches in increasingly smaller enclosures providing little room for maneuvering. This requires electrical components which can be assembled without complicated tools, or preferably, without any tools.

Other problems caused by assembling the fusible switch interiors is the quantity of parts that must be tracked inventoried, and supplied in the field to properly complete the assembly. A reduced part count and less manual labor during assembly would decrease installation time and cost.

Furthermore, the parts for the switch interior must be economical to manufacture. A switch which assembles easier and faster at a comparable cost allows more widespread application.

SUMMARY OF THE INVENTION

Accordingly, the present invention provides an interior assembly for an electrical distribution device having a fuse for each phase in a circuit. The interior assembly includes a plurality of modules having an operating mechanism for opening and closing a switch contact. The switch contact is connected to each fuse and phase of the circuit. Each module has a housing and means for demountably securing one of the modules to at least one adjacent module. The securing means is manually operated and integrally formed with the housing of each module.

The present invention also includes a switch mechanism module for an electrical distribution device having an enclosure with a handle external to the enclosure for operator control. The switch mechanism module includes a modular housing having a generally planar first base with upstanding side walls around the circumference of the first base. The side walls have a top edge defining a mating surface. The modular housing has a generally planar second base with upstanding side walls having a top edge for abutting the mating surface of the first base and means for demountably fastening the first base to the second base The fastening means is integrally formed with the first and second base. A shaft connects with the handle external to the modular housing at one end. The second end connects to the adjacent module of the interior assembly through the modular housing. An operating mechanism is connected to the shaft and the first and second bases without discrete fasteners and means for demountably securing the housing to at least one adjacent module of the interior assembly The securing means is manually operated and integrally formed with the modular housing.

The present invention also contemplates one of the modules as a line base module for an electrical distribution device having a fuse for each phase in a circuit. The line base module includes a modular housing having a generally planar base with upstanding side walls around the circumference of the base. The side walls have a top edge defining a mounting surface. A terminal connects to one end of the circuit for each phase and is fastened to the base. A fuse lug connects to the fuse on the opposite end of the circuit for each phase and is fastened to the base. A switch contact for opens and closes the circuit for each phase. The switch contact connects between the terminal and the fuse lug and is fastened to the base. A rotor connects with the adjacent module of the interior assembly. The rotor operatively connects to the switch contact of each phase and rotatably secures to the mounting surface of the side walls without discrete fasteners. The line base module includes means for demountably securing the housing to at least one adjacent module. The securing means is manually operated and integrally formed with the modular housing.

The present invention further contemplates one of the modules as an integrated module for a switch mechanism and line base for an electrical distribution device having an enclosure with a handle external to the enclosure for operator control and a fuse for each phase in a circuit. The integrated module includes a modular housing having a generally planar first, second, and third base. The first base has upstanding side walls around the circumference of the first base. The side walls have a top edge defining a mating surface. The second base has upstanding side walls with a top edge for abutting the mating surface of the first base. The third base has upstanding side walls around the circumference of the base. The side walls of the third base have a top edge defining a mounting surface. The first and third bases have a portion of their respective side walls integrally formed together so that the first and third bases are adjacent to each other. The integrated module includes means for demountably fastening the first base to the second base. The fastening means is integrally formed with the first and second base. A shaft connects with the handle external to the modular housing. An operating mechanism connects to the shaft and the first and second base without discrete fasteners. A terminal connects to one end of the circuit for each phase.. The terminal is fastened to the base. A fuse lug connects to the fuse on the opposite end of the circuit for each phase and is fastened to the base. A switch contact for opens and closes the circuit for each phase. The switch contact connects between the terminal and the fuse lug. The switch contact is fastened to the base and a rotor connects with the second end of the shaft through the portion of the first and third base side walls integrally formed together. The rotor is operatively connected to the switch contact of each phase and is rotatably secured to the mounting surface of the side walls without discrete fasteners.

Also included in the present invention is a base module for stacking fuses in an electrical distribution device having a fuse for each phase in a multi-phase circuit. The base module includes a generally planar base with upstanding side walls around each phase mounted on the base. A plurality of terminals connects to one end of the circuit for each phase and is fastened to the base. A plurality of fuse lugs connect to the fuse on the opposite end of the circuit for each phase. Each fuse lug is fastened to the base and at least one of the fuse lugs is fastened to the base in a plane offset from the other fuse lugs.

The present invention also provides a neutral base module connecting the electrical distribution device to a circuit having at least one phase. The neutral base module includes a generally rectangular body having a mounting surface and means for demountably securing the body to at least one adjacent module of the interior assembly. The means is manually operated and integrally formed with the body. A terminal for making an electrical connection has a face for abutting the mounting surface of the body. An electrically insulating shield has sufficient size to substantially isolate the body from the adjacent module of the interior assembly. The shield abuts the body and terminal. The neutral base module also includes means for releasably retaining the terminal abutting the mounting surface and the shield between the body and the adjacent module The retaining means is integrally formed with the body.

The present invention also contemplates an interior assembly for stacking fuses in an electrical distribution device having a fuse for each phase in a multi-phase circuit. The interior assembly includes a line base module having a generally planar line base with upstanding side walls around each phase mounted on the line base and a plurality of line terminals for connecting to the line end of the circuit for each phase. Each line terminal is fastened to the line base. A plurality of switch contacts for open and close the circuit for each phase and each switch contact is fastened to the line base. A rotor operatively connects to each of the switch contacts. The side walls of the line base have a top edge defining a mounting surface. The rotor is rotatably secured to the mounting surface of the side walls without discrete fasteners. A load base module has a generally planar load base with upstanding side walls around each phase mounted on the load base and a plurality of load terminals for connecting to the load end of the circuit for each phase. Each load terminal is fastened to the load base. A plurality of fuse lug pairs connect to the fuse each phase of the circuit. Each fuse lug pair has one fuse lug fastened to the line base and the associated fuse lug fastened to the load base. At least one of the fuse lug pairs is fastened to the line and load bases in a plane offset from the other fuse lug pairs.

The present invention also provides a handle for controlling a switch mechanism of an interior assembly of an electrical distribution device having a plurality of modules. The electrical distribution device has an enclosure for housing the interior assembly. The handle includes a first piece having an elongated shape with two ends. The first end is adapted to be manually controlled by an operator and having a mating surface. The opposite end has means for securing the handle to the switch mechanism. A second piece has a complimentary shape for abutting the mating surface of the first piece at least near the first end. The handle also includes means for fastening the first and second pieces without discrete fasteners. The fastening means is integrally formed with the first and second pieces.

The present invention also contemplates a method of assembling the interior assembly of an electrical distribution device having a fuse for each phase in a circuit. The step of the method includes manually and demountably affixing a plurality of modules to one another without discrete fasteners. The plurality of modules have an operating mechanism for opening and closing a switch contact. The switch contact is connected to each fuse and phase of the circuit.

An object of the present invention is to provide a fuse switch which reduces the part count, the need for discrete fasteners, and the labor content needed for a completed assembly compared to the prior art.

Another object of the present invention is to provide a switch assembly having modular components which are interchangeable and assemble with a minimum of tools.

Still another object of the present invention is to provide a switch capable of operating at a comparable voltage and current density having a more compact design.

A further object of the present invention is to provide a fuse switch which is inexpensive to manufacture and accommodates a variety of fuse types without additional hardware for installation.

A still further object of the present invention is to provide a fuse switch which can be built in a factory or other location remote to where the switch is assembled in its entirety.

Another object of the invention is to provide individual modules of an interior switch assembly that have mounting features integrally formed therewith. provide for assembly along a single axis, and snap-together to reduce riveting and preening of parts.

Other and further advantages, embodiments, variations and the like will be apparent to those skilled-in-the-art from the present specification taken with the accompanying drawings and appended claims.

BRIEF DESCRIPTION OF THE DRAWINGS

In the drawings, which comprise a portion of this disclosure.

DESCRIPTION OF THE PREFERRED EMBODIMENT

Figure 1:
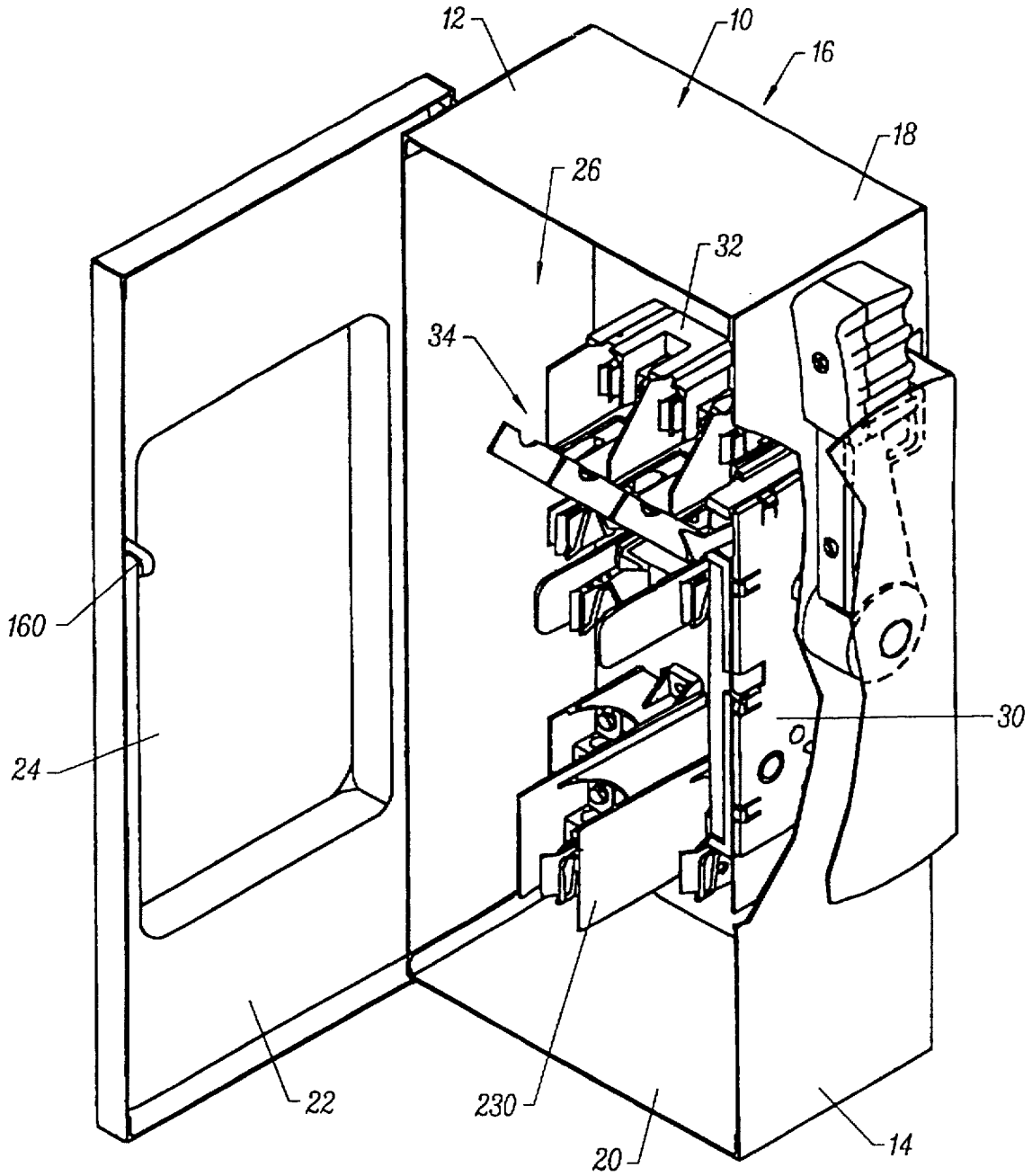
FIG. 1 is a perspective view of a fusible switch with a modular interior assembly of the present invention.

Referring now to FIG. 1, a fusible switch for a multi-phase circuit is generally indicated by the reference numeral 10. The switch 10 includes an enclosure 12 defined by sidewalls 14, a backwall 16, a top wall 18, and a bottom wall 20. The switch 10 is enclosed by cover panel 22 which connects to one of the sidewalls 14 and provides an offset portion 24 for additional clearance with an interior assembly of components generally designated as 26.

In a multi-phase circuit, there is an electrical power line to service each respective phase entering the enclosure 12 usually through the top wall 18 and/or bottom wall 20. The switch 10 described and illustrated herein is for a three- or two-phase circuit. In accordance with the teachings available in the electrical art, it would be within the skill of one to change the number of phases and modify the invention accordingly.

Figure 2:
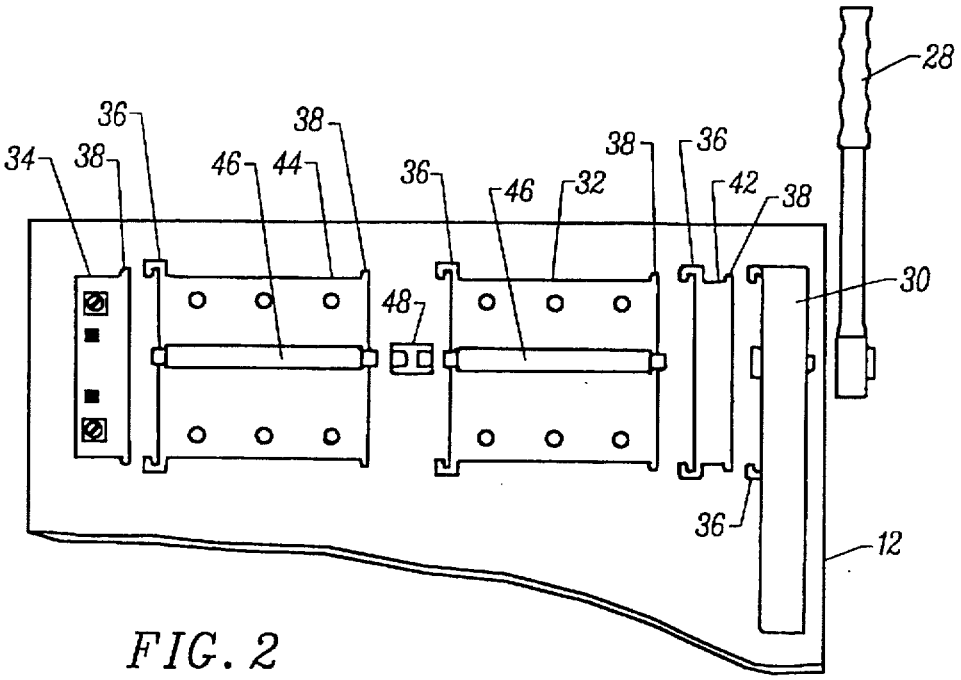
FIG. 2 is a partial front view of an alternate embodiment of the modular interior assembly illustrated in FIG. 1.

As illustrated by the fuse switch embodiment in FIG. 2, the present invention generally provides the interior assembly 26 with a plurality of modules such as a handle 28, a switch mechanism 30, a line base 32, and a neutral base 34. The individual modules of the interior assembly 26 are easily aligned and assembled by connecting prongs like 36 extending outwardly from one end of the line base 32 with retaining flanges like 38 extending outwardly from the edge of neutral base 34. Except for the end module like the neutral base 34, each module like the line base 32 has the prongs 36 on one end and the retaining flanges 38 on the opposite end to correspond to the prongs of another module. The present invention contemplates using both the prongs 36 and the retaining flanges 38 on the same end of the module. The interior assembly 26 may also include a spacer module 42 to adjust the position of the modules within the enclosure 12.

FIG. 2 also demonstrates the flexibility of the interior assembly 26 by customizing and expanding through the addition of a second line base 44. The addition is made by detaching the neutral base 34 from the line base 32, attaching the flanges 38 of the second line base 44 to the prongs 36 of the line base 32, and attaching the flanges 38 of the neutral base 34 to the prongs 36 of the second line base 44. The line base 32 and the second line base 44 have rotors 46 which are connected by a rotor coupler 48. The mating between the modules, which will be discussed in more detail below, can be made without tools and an inventory of additional parts. The present invention provides a uniform means of securing each module of the interior assembly 26 to one another regardless of the function of the individual module in the switch 10. The present invention also contemplates the use of other securing means such as snap-locks, etc.

Now each of the modules of the interior assembly 26 will be described in more detail. Turning to FIG. 3A, the handle 28 preferably includes a first piece 60 having an elongated shape with one end 62 forming a hand-grip 64. Other means adapted to be manually controlled by an operator are also suitable for use by the invention. The opposite end 66 of the first piece provides a connecting rod 68 or other means for fixedly securing to and operating the switch mechanism 30 by converting the translational movement of the hand-grip 64 into a rotational movement. The first piece 60 preferably provides an aperture 70 to allow locking of the handle 28 with a padlock (not shown) or the like to prevent unauthorized operation of the switch 10.

The handle 28 also includes a second piece 72 which mates with the first piece 60 to near the end 62 to complete the hand-grip 64. The first and second pieces 60, 72 are demountable fastened to each other by screws 74 passing through holes 76 in the second piece 72 to threadingly engage corresponding cylinders 78 reinforced in the interior 80 of the first piece 60.

Figure 3B:
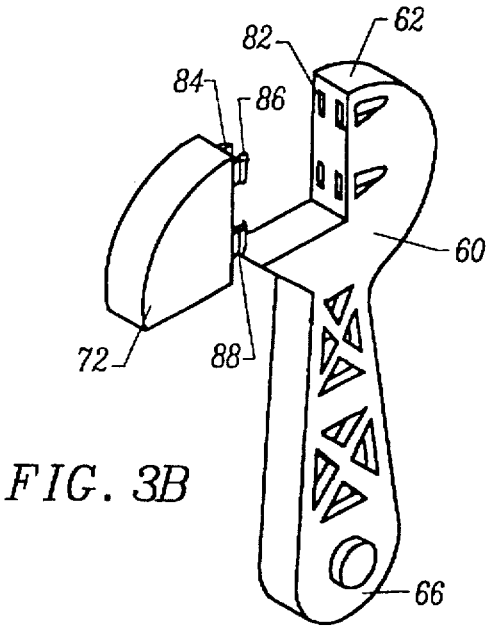
FIG. 3B is an isolated, exploded perspective view of an alternate embodiment of the handle illustrated in FIG. 3A.

Another embodiment of the handle 28 is illustrated in FIG. 3B to provide other examples of means for fastening the pieces 60, 72 together without discrete fasteners and end 62 having a knob shape adapted for manual control by an operator. The first piece 60 of the handle includes apertures 82 which are sized to accept corresponding prongs 84 extending perpendicularly from the surface of the second piece 72. Each prong 84 has a resilient body which flexes as a head 86 engages the corresponding edge of the aperture 82 to form a snapfit and fasten the pieces 60, 72 together. To retain each prong 84 at the corresponding edge of the aperture 82, an undercut 88 is integrally formed in the body of the prong between the head 86 and the surface of the second piece 72.

Figure 3C:
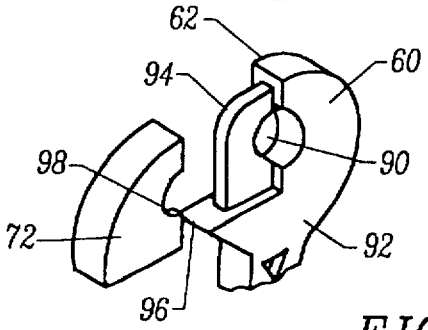
FIG. 3C is a partial, exploded view of another embodiment of the handle illustrated in FIG. 3A.
Figure 3A:
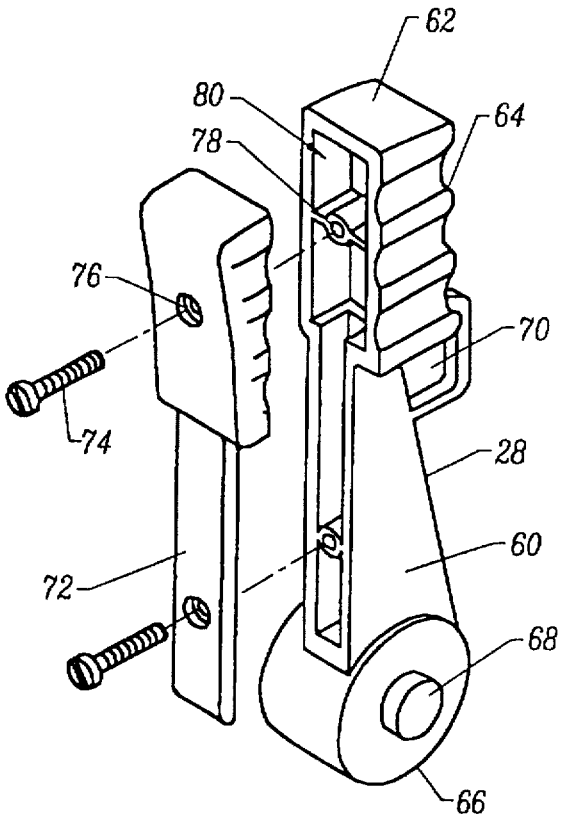
FIG. 3A is an isolated, exploded perspective view of a handle for the fusible is switch.

Another embodiment of the handle 28 is illustrated in FIG. 3C to provide other examples of means for fastening the pieces 60, 72 together without discrete fasteners. First piece 60 includes a hole 90 through a side face 92 of the piece. A projection 94 extends outwardly from an interior face 96 of the piece near end 62. The second piece 72 has an indentation 98 of corresponding shape adapted to mate with the projection 94. Either the projection 94 or the walls of the indentation 98 or both are resilient to allow for a demountable, snap-fit engagement between them.

Preferably, the first and second pieces 60, 72 are made of an engineering thermoplastic resin of different colors to provide a visual warning to the operator of the open or closed condition of the switch 10. The resin needs to have sufficient mechanical strength to provide leverage from the hand-grip 64 to the opposite end 66 of the handle and can be formed by conventional molding techniques. To provide the diversity of color, it is economically preferred that the hand-grip 64, knob, or other means adapted to be manually controlled by an operator is made of at least two separate pieces. Although it is feasible to make a one-piece handle using a conventional co-molding process.

Figure 4:
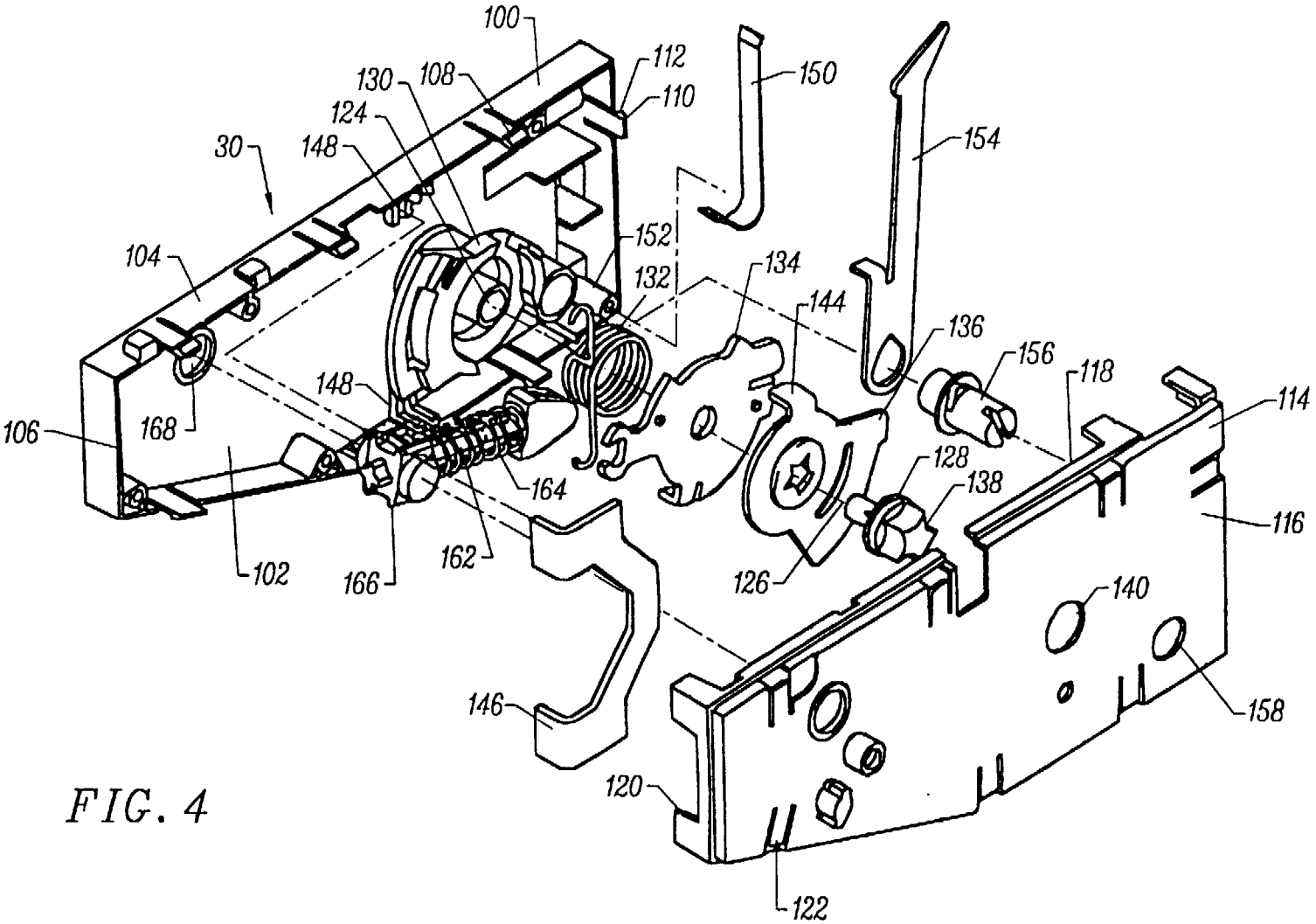
FIG. 4 is an isolated, exploded perspective view of the switch mechanism illustrated in FIG. 1.

Referring now to FIG. 4, the switch mechanism 30 includes a first housing 100 having a generally planar body 102 with side walls 104 upstanding perpendicularly along the circumference of the body 102 to form a top edge 106 defining a mating surface. The side walls 104 have a plurality of prongs 108 integrally formed therewith. Each prong 108 has a resilient body which extends upwardly from the top edge 106 to form a head 110 with an undercut 112. The switch mechanism 30 also includes a corresponding second housing 114 which similarly has a generally planar body 116 with side walls 118 upstanding perpendicularly along the circumference of the body 116 having a top edge 120 for abutting the top edge 106 of the first housing. The prongs 108 engage a plurality edges defining apertures 122 integrally formed in the side walls 118 with a snap-fit relationship to fasten the housings 100, 114 together. The prongs 108 and edges of the apertures 122 provide means for fastening the housing 100, 114 together without discrete fasteners. The first housing 100 includes a reinforced cylinder 124 to rotatably retain one end 126 of a mechanism shaft 128 as it extends through a rotor cam 130 which is secured to the rotor 44 external to the lower housing 100. The mechanism shaft 128 also rotatably secures a bias spring 132, an operator cam 134, and a handle cam 136. The opposite end 138 of the mechanism shaft connects to the handle 28 of FIG. I extending through shaft holes 140 in the housings 100, 114. As the handle 28 rotates the mechanism shaft 128 and the handle cam 136, a cam arm 144 engages a pre-determined point on the operator cam 134 with a lost motion movement. The movement of the operator cam 134 similarly engages the bias spring 132 and the rotor cam 130 to eventually supply the bias of the spring 132 in a quick make or break motion to the rotor 44 connected to the rotor cam 130. A cam stop 146 is mounted between retaining clips 148 integrally formed on the interior side of the lower housing 100.

Similarly, one end of an interlock spring 150 engages a reinforced cylinder 152 integrally formed with the lower housing 100. The interlock spring 150 provides bias to a cover interlock arm 154 which is rotatably supported on an interlock shaft 156 which engages second shaft holes 158 formed in the housings 100, 114. The cover interlock arm 154 engages the operator cam 134 to lock the cover 22 of the enclosure by engaging latch 160 found in FIG. 1.

The operator cam 134 also engages one end of a push rod 162 which is biased by an operator spring 164. The opposite end of the push rod 162 rotatably engages a pushrod pivot 166 which is rotatably secured to pivot holes 168 in the housings 100, 114. The operator spring 164 provides energy storage means as the spring compresses until the apex of the pivot is reached and releases upon passing the apex of the pivot. The push rod 162 passes through the interior of the operator spring 164 to retain the operator spring 164 in position between the operator cam 134 and the pushrod pivot 166 even as the operator cam 134 rotates, reversibly extending the pushrod 162 through the pushrod pivot 166 as the operator spring 164 reversibly compresses between the operator cam 134 and the pushrod pivot 166.

The switch mechanism 30 advantageously provides an easy method of assembly along the axis parallel to the position of the mechanism shaft 128, the snap-fit relationship between the housings 100, 114, and the use of integrally formed members like the retaining clips 148 to position parts without discrete fasteners. The housings 100, 114 also provide for attachment with other modules in the interior assembly 26 as previously depicted in FIGS. 1 and 2.

Figure 5:
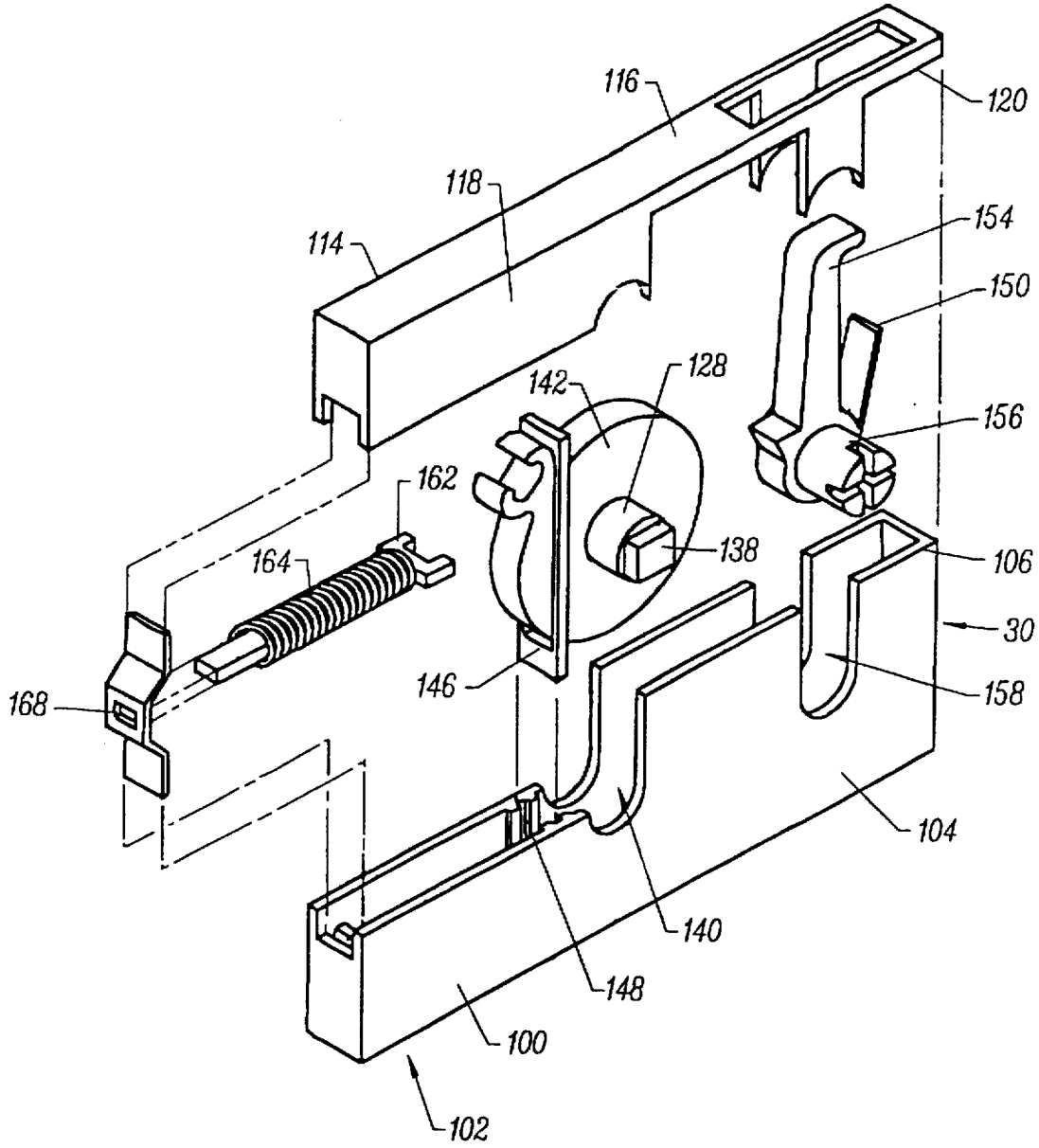
FIG. 5 is an isolated, exploded perspective view of an alternate embodiment of the switch mechanism illustrated in FIG. 4.

Another embodiment of the switch mechanism 30 is illustrated in FIG. 5 demonstrating an advantageous assembly along an axis perpendicular to the shaft mechanism 128. The same reference numerals refer to like parts between FIG. 4 and FIG. 5. Accordingly, the switch mechanism 30 includes a first housing 100 having a generally planar body 102 with side walls 104 upstanding perpendicularly along the circumference of the body 102 to form a top edge 106 and define a mating surface. The switch mechanism 30 also includes a corresponding second housing 114 which similarly has a generally planar body 116 with side walls 1 18 upstanding perpendicularly along the circumference of the body 116 to form a top edge 120 which abuts the top edge 106 of the first housing. As previously described, prongs engage a plurality of edges defining apertures integrally formed in the side walls with a snap-fit relationship to fasten the housings 100, 114 together. The prongs and apertures are not shown in FIG. 5 to illustrate with more clarity the other features.

The top edges 106 and 120 of the housings mate to define shaft holes 140 to rotatably secure a mechanism shaft 128 therebetween. Connected to the mechanism shaft 128 is a cam assembly 142 which includes the rotor cam, bias spring, operator cam 134, and handle cam 136 previously discussed. The opposite end 138 of the mechanism shaft connects to the handle 28 of FIG. I extending through shaft holes 140 in the housings 100, 114. As the handle 28 rotates the mechanism shaft 128 and cam assembly 142 with a lost motion movement. A cam stop 146 is mounted between retaining clips 148 integrally formed on the interior side of the lower housing 100.

Similarly, one end of an interlock spring 150 engages the lower housing 100. The interlock spring 150 provides bias to a cover interlock arm 154 which is rotatably supported on an interlock shaft 156 which engages second shaft holes 158 formed in the housings 100, 114. The cover interlock arm 154 engages the operator cam 134 to lock the cover 22 of the enclosure by engaging latch 160 found in FIG. 1.

The cam assembly 142 also engages one end of a push rod 162 which is biased by an operator spring 164. The opposite end of the push rod 162 rotatably engages a pushrod pivot 166 which is rotatably secured to pivot holes 168 in the housings 100, 114 as seen in FIG. 4 and to a single pivot hole 168 as illustrated in FIG. 5. The switch mechanism 30 advantageously provides an easy method of assembly along the axis perpendicular to the position of the mechanism shaft 128, the snap-fit relationship between the housings 100, 114, and the use of integrally formed members like the retaining clips 148 to position parts without discrete fasteners. The housings 100, 114 also provide for attachment with other modules in the interior assembly 26 as previously depicted in FIGS. 1 and 2.

Figure 6:
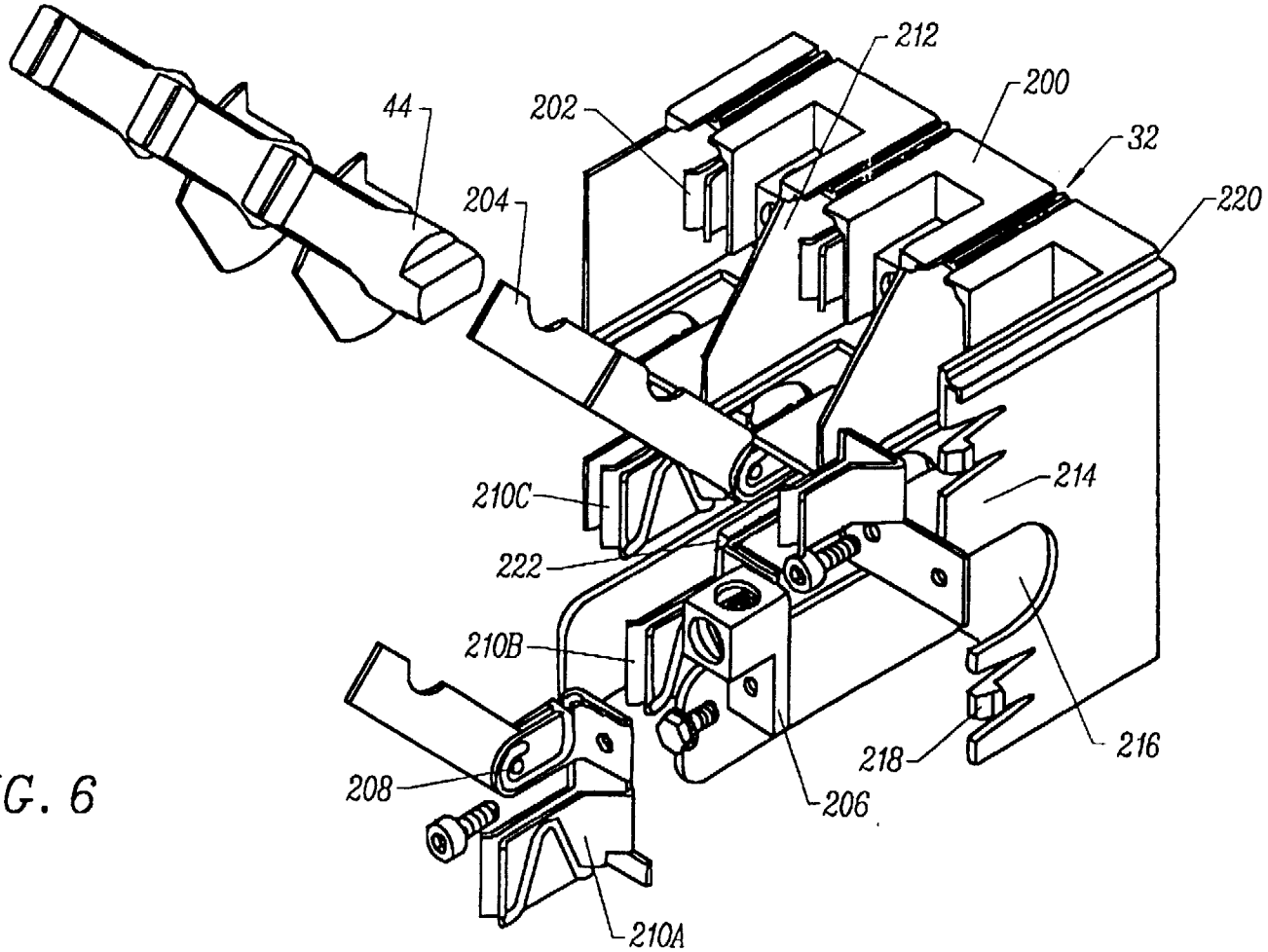
FIG. 6 is an isolated, exploded perspective view of a three phase line base component of the sent invention.

Preferably, the present invention includes the line base 32 as further illustrated in FIG. 6 in a three phase embodiment with a modular and stackable fuse arrangement. The line base 32 includes a generally planar insulating base 200 integrally formed of known insulating material such as the thermoplastic sold by the General Electric Company under the name Valox 420 or 750. The insulating base 200 is secured to the backwall 16 by any conventional fastening means.

A plurality of switch contacts 202 are mounted in spaced apart positions on the insulating base 200 and connect to respective line service for each phase. Each switch contact 202 includes a pair of upstanding cantilever spring legs forming a pair of spring jaws for receiving a respective switch or knife blade 204 between the respective jaws.

For each phase, the knife blade 204 is secured between the vertical legs of a line terminal 206 by a rivet 208 or the like for pivoting movement about common axis for each blade 204. Line terminal 206 is secured to the insulating base 200 and is electrically connected to a fuse lug 210A. Each fuse lug 210A–C includes a pair of cantilever arcuate jaw members for receiving the end of a fuse and are reinforced with a wire located on the outer side of each jaw member to prevent excessive bending when the fuse end is inserted. For each phase, the spaced apart partitions of the line terminal 206, fuse lug 210, fuse, knife blade 204, and switch contact 202 correspond in alignment so the electrical connection is provided through the switch contact and fuse from the service line.

Partition walls 212 are located between each line terminal 206 and fuse lugs 210A–C on the insulating base 200. Outer partition walls 214 are located on the insulating base 200 and are provided with respective aligned recesses 216 to define a mating surface for receiving the rotor 44 which carries the knife blades 204. The rotor 44 is seated between the edges of the recesses 216 and between the switch contacts 202 and the knife blades 204. Rotating the rotor 44 engages and disengages the switch contacts 202 and the knife blades 204. One end of the rotor 44 extends to engage the switch mechanism 30 as previously described.

The outer partition walls 214 also have prongs 218 integrally formed therewith for engaging an adjacent module of the interior assembly with a snap-fit relationship. Similarly, flange 220 provides a corresponding engagement with an adjacent module of the interior assembly.

Each switch contact 202 is overlapped by a conventional arc suppresser assembly (not shown) attached to the line base 32. The arc suppresser assembly effectively surrounds the switch contacts 202 to protect other components in the switch 10O from damage by quenching the arc released when the knife blade 204 engages or disengages the switch contact 202.

The line base 32 provides a stacking arrangement for the fuse lugs 210A–C. Specifically, fuse lug 210B is offset in a plane above fuse lugs 210A and 210C which are in the same plane as the insulating base 200 by mounting fuse lug 210B on a fastening surface provided by a pedestal integrally formed with the base 32. This effectively moves the center lines of each of the fuses closer together. The present invention contemplates having all three fuse lugs 210A–C, or as many phases that there are, in a different plane from one another. For example, fuse lug 210B can be mounted in a plane offset below the other fuse lugs such as in a depression in the base 32. The present invention contemplates mounting the switch contact with the associated fuse lug in the same offset plan or separately in a different plane than the offset plane where the offset fuse lug is mounted. The stacking arrangement provides a more compact design and still provides easy access to the fuses with conventional fuse pullers. Yet, the switch contacts 202 are all in the same plane as the insulating base 200. A single straight design can then be used for the rotor 44 to control the switch contacts 202.

Figure 7:
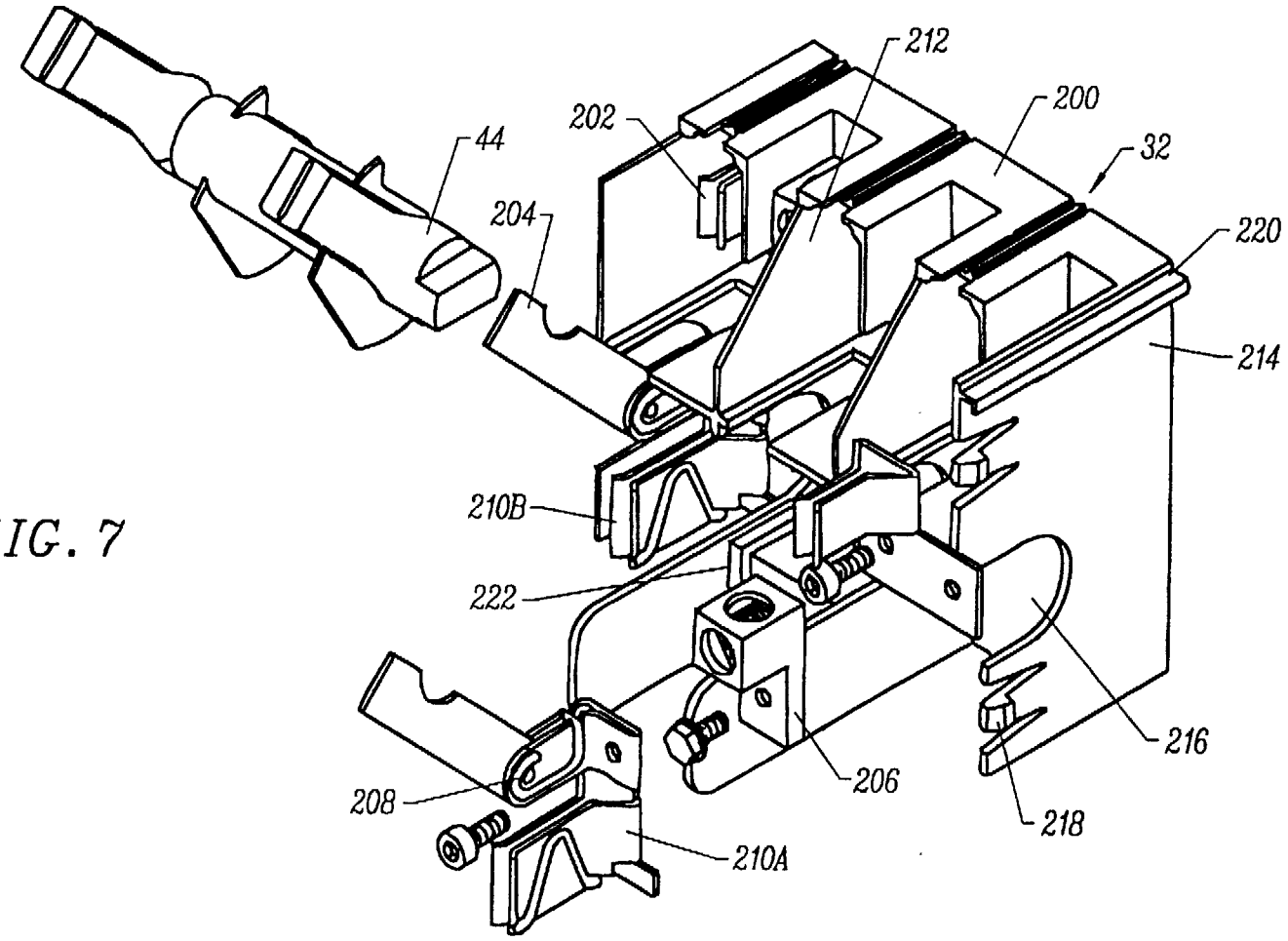
FIG. 7 is an isolated, exploded perspective view of a two phase line base component of the present invention.

Another embodiment of the line base 32 is illustrated in FIG. 7 demonstrating an advantageous modular and stacking arrangement for a two-phase switch. The same reference numerals refer to like parts between FIG. 6 and FIG. 7. The line base 32 includes a generally planar insulating base 200 A plurality of switch contacts 202 are mounted in spaced apart positions on the insulating base 200 and connect to respective line service for each phase. Each switch contact 202 includes a pair of upstanding cantilever spring legs forming a pair of spring jaws for receiving a respective switch or knife blade 204 between the respective jaws.

For each phase, the knife blade 204 is secured between the vertical legs of a line terminal 206 by a rivet 208 or the like for pivoting movement about common axis for each blade 204. Line terminal 206 is secured to the insulating base 200 and is electrically connected to fuse lugs 210A. 210B. The fuse lugs 210A, 210B include a pair of cantilever arcuate jaw members for receiving the end of a fuse.

Partition walls 212 are located between each line terminal 206 and fuse lugs 210A–C on the insulating base 200. Outer partition walls 214 are located on the insulating base 200 and are provided with respective aligned recesses 216 for receiving the rotor 44 which carries the knife blades 204. The rotor 44 is seated between the edges of the recesses 216 and between the switch contacts 202 and the knife blades 204. Rotating the rotor 44 engages and disengages the switch contacts 202 and the knife blades 204. One end of the rotor 44 radically extends to engage the switch mechanism 30 as previously described.

The outer partition walls 214 also have prongs 218 integrally formed therewith for engaging an adjacent module of the interior assembly with a snap-fit relationship. Similarly, flange 220 provides a corresponding engagement with an adjacent module of the interior assembly.

Figure 8:
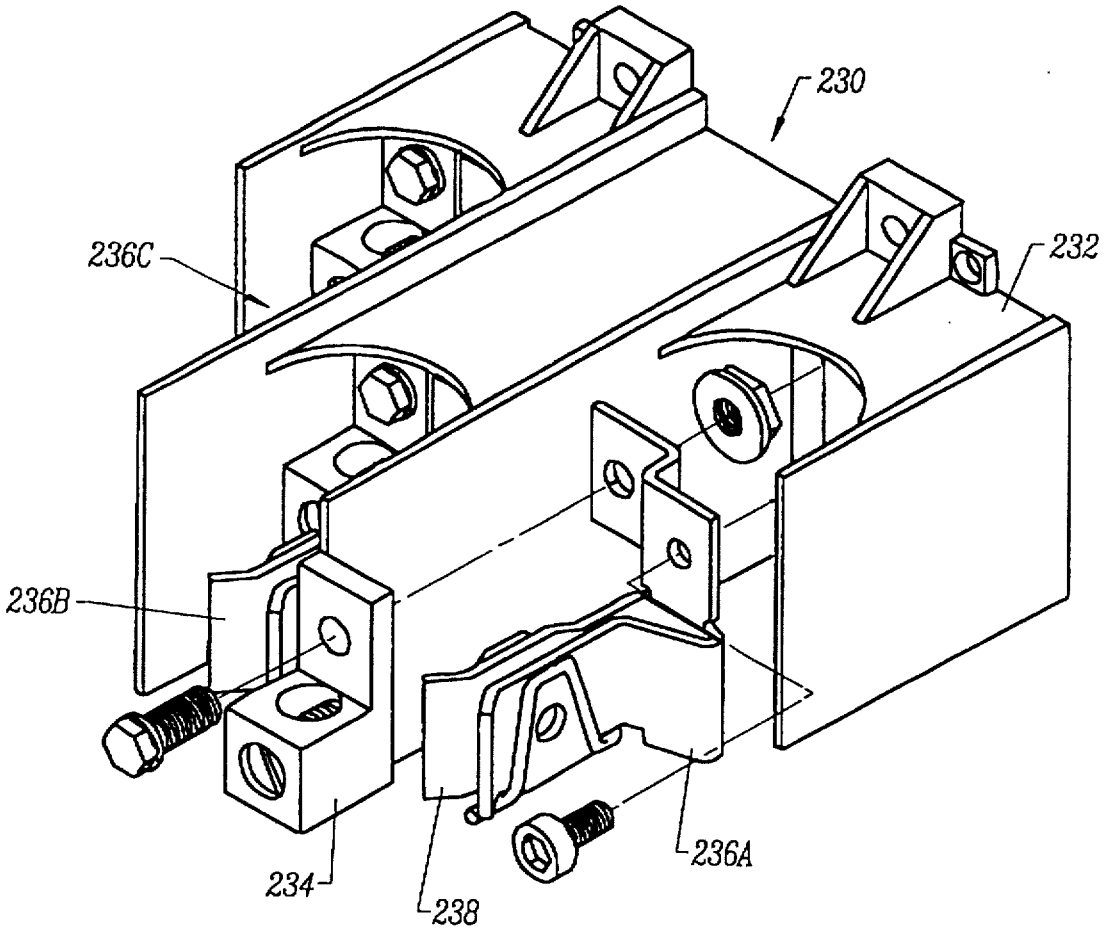
FIG. 8 is an isolated perspective view of a three phase load base component of the present invention.

Preferably, the present invention includes a load base 230 as further illustrated in FIG. 8 in a three phase embodiment with a stackable fuse arrangement. The load base 230 includes a load insulating base 232 integrally formed of known insulating material such as the thermoplastic sold by the General Electric Company under the name Valox 420 or 750. The load insulating base 232 is secured to the backwall 16 of the switch 10 by any conventional fastening means.

A plurality of load terminals 234 are mounted in spaced apart positions on the load insulating base 232. Each phase connects a load line to a respective load terminal 234. One of the load fuse lugs 236A–C is connected to each load terminal 234 and includes a pair of arcuate jaw members 238 for receiving the end of a fuse therebetween. The jaw members 238 are reinforced with a wire located on the outer side of each jaw member to prevent excessive bending when the fuse end is inserted.

The load base 230 provides a stacking arrangement for the fuse lugs 236A–C. Specifically, fuse lug 236C is offset in a plane above fuse lugs 236A and 236C which are in the same plane as the load insulating base 232 as discussed above.

This effectively moves the center lines of each of the fuses closer together. The present invention contemplates having all three fuse lugs 236A–C, or as many phases that there are, in a different plane from one another. The stacking arrangement provides a more compact design and still provides easy access to the fuses with conventional fuse pullers.

Figure 9:
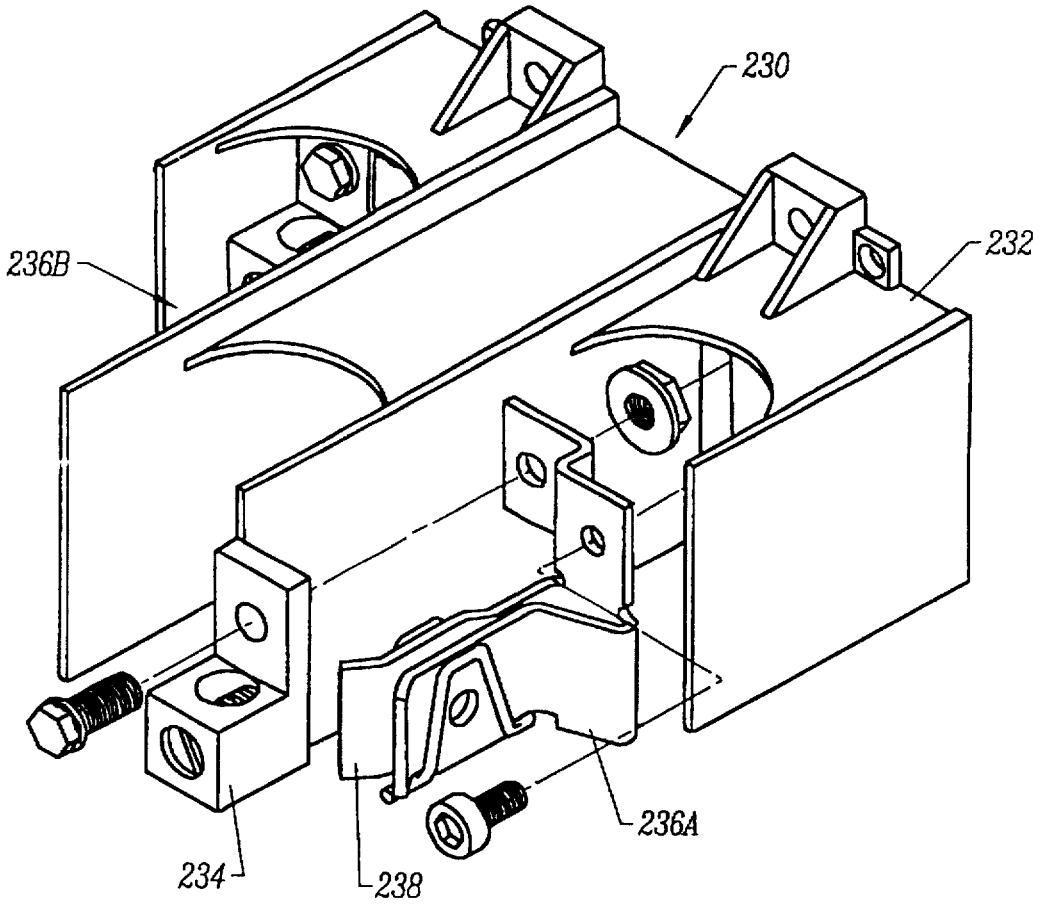
FIG. 9 is an isolated perspective view of a two phase load base component of the present invention.

Another embodiment of the load base 230 is illustrated in FIG. 9 demonstrating an advantageous stacking arrangement for a two-phase switch. The same reference numerals refer to like parts between FIG. 8 and FIG. 9. The load base 230 includes an insulating base 232 integrally formed of known insulating material such as the thermoplastic sold by the General Electric Company under the name Valox 420 or 750. A plurality of load terminals 234 are mounted in spaced apart positions on the load insulating base 232. Each phase connects a load line to a respective load terminal 234. Load fuse lugs 236A-B are connected to each load terminal 234 and includes a pair of arcuate jaw members 238 for receiving the end of a fuse therebetween. The jaw members 238 are reinforced with a wire located on the outer side of each jaw member to prevent excessive bending when the fuse end is inserted.

The load base 230 provides an optional stacking arrangement for the fuse lugs 236A–B. Specifically, fuse lug 236B could be offset in a plane above fuse lug 236A which is in the same plane as the load insulating base 232. This effectively moves the center lines of each of the fuses closer together. The stacking arrangement provides a more compact design and still provides easy access to the fuses with conventional fuse pullers.

Figure 10:
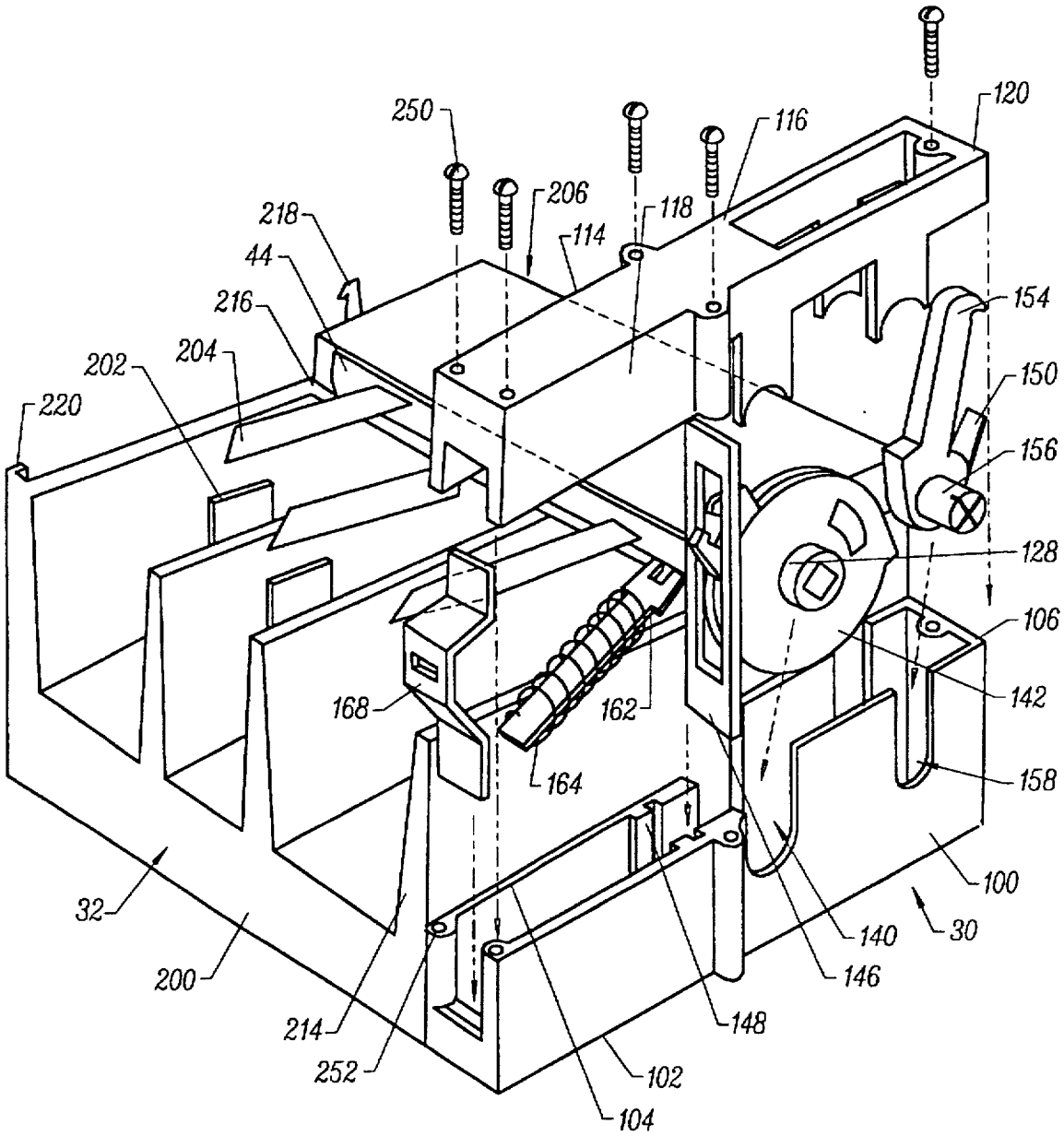
FIG. 10 is an isolated perspective view of an integral switch mechanism and line base component of the present invention.

One of the advantages of the present invention is to integrate more than one individual module of the interior assembly as illustrated, for example, in FIG. 10. The switch mechanism 30 is integrated with the line base 32. The same reference numerals refer to like parts between FIG. 5, FIG. 6, and FIG. 10. Accordingly, the switch mechanism 30 includes a first housing 100 having a generally planar body 102 with side walls 104 upstanding perpendicularly along the circumference of the body 102 to form a top edge 106 and define a mating surface. One of the side walls 104 is integrally formed with a portion of the side walls 214 defining a third housing represented by the insulating base 200 of the line base 32. The switch mechanism 30 also includes a corresponding second housing 114 which similarly has a generally planar body 116 with side walls 118 upstanding perpendicularly along the circumference of the body 116 to define top edge 120 and mate with the top edge 106 of the first housing. Since one of the side walls 104 is integrally formed with the insulating base 200, an example of a different means for fastening the second housing 114 to the first housing 100 is used such as the screws 250 threadingly engage corresponding cylinders 252.

The mating of housings 100, 114 define shaft holes 140 to rotatably secure a mechanism shaft 128 therebetween. Each offset flange includes a distal end 313 and a proximal end 315. The proximal end 315 is open to receive the corresponding edge 314 of the terminal. The distal end 313 is closed to stop the sliding advance of the corresponding edge 314 under the offset flange. The mechanism shaft 128 connects to a cam assembly 142 which includes the rotor cam, bias spring, operator cam 134, and handle cam 136 as previously discussed. The opposite end 138 of the mechanism shaft connects to the handle 28 of FIG. I extending through shaft holes 140 in mating of the housings 100, 114. As the handle 28 rotates the mechanism shaft 128 and cam assembly 142 with a lost motion movement. A cam stop 146 is mounted between retaining clips 148 integrally formed on the interior side of the lower housing 100.

Similarly, one end of an interlock spring 150 engages the lower housing 100. The interlock spring 150 provides bias to a cover interlock arm 154 which is rotatably supported on an interlock shaft 156 which engages second shaft holes 158 formed in the housings 100, 114. The cover interlock arm 154 engages the operator cam 134 to lock the cover 22 of the enclosure by engaging latch 160 found in FIG. 1.

The cam assembly 142 also engages one end of a push rod 162 which is biased by an operator spring 164. The opposite end of the push rod 162 rotatably engages a pushrod pivot 166 which is rotatably secured to pivot holes 168 in the housings 100, 114. The switch mechanism 30 advantageously provides an easy method of assembly along the axis perpendicular to the position of the mechanism shaft 128 and greater integrity of the connection between the two modules.

Figure 11A:
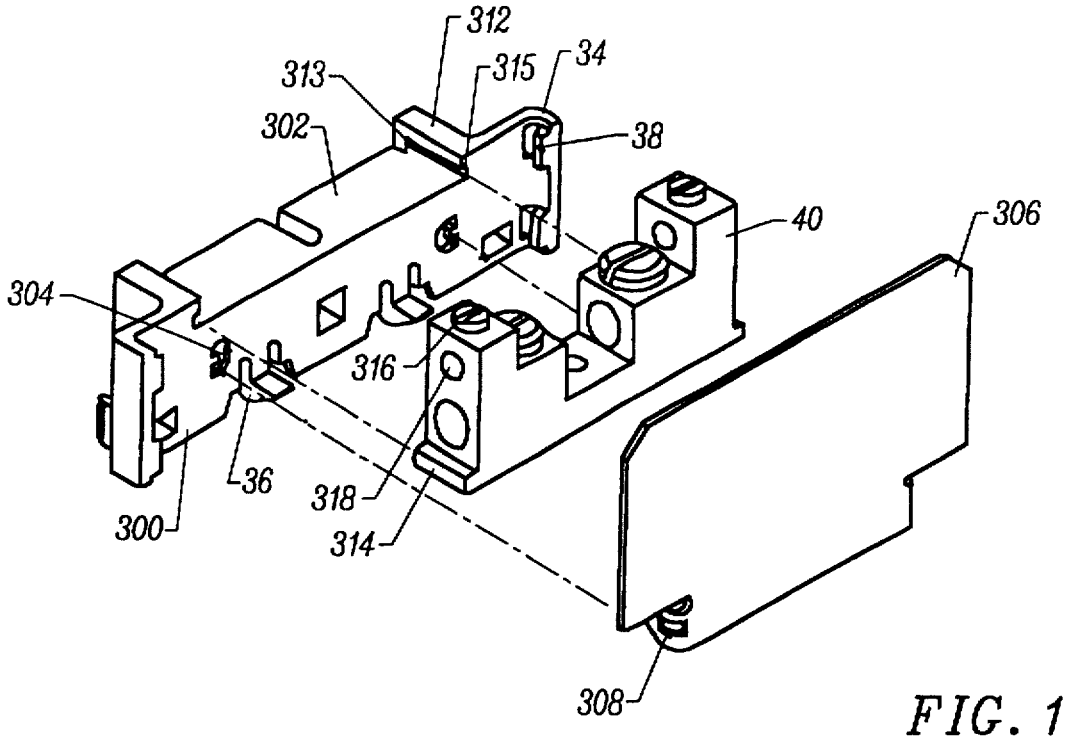
FIG. 11A is an isolated, exploded perspective view of a neutral-interlock switch component of the sent invention.

Preferably, the present invention includes the neutral base 34 as further illustrated in FIG. 11A. The neutral base 34 has a side face 300 and a top face 302. Recessed prongs 304 are integrally formed with the side face 300. The recessed prongs 304 provide means for fastening the neutral base 34 to the electrical terminal 40 and an insulator 306 with a snap-fit relationship to corresponding edges defining apertures 308 in the insulator 306. Each offset flange includes a distal end 313 and a proximal end 315. The proximal end 315 is open to receive the corresponding edge 314 of the terminal. The distal end 313 is closed to stop the sliding advance of the corresponding edge 314 under the offset flange. The neutral base 34 includes a pair of offset flanges 312 located parallel to the top face 302 in an offset position sufficiently large to accommodate a corresponding edge 314 of the electrical terminal 40. The neutral base 34 also includes the flanges 38 and prongs 36 parallel to the side face 300 and described earlier for engaging an adjacent module of the interior assembly 26.

The electrical terminal 40 includes a plurality of lugs 316 and openings 318 which provide electrical connections by crimping the ends of wires inserted into the openings 318 between the lug 316 and the body of the electrical terminal 40. The edge 314 corresponds in size to the offset flanges 312 to slide underneath and be retained thereby.

The insulator 306 is subsequently attached to the neutral base 34 by the snap-fit relationship between the edges of apertures 308 and the recessed prongs 304. As a result, the electrical terminal 40 is also retained in positioned with the neutral base 34. The flanges 38 and prongs 36 of the neutral base can then engage an adjacent module for final assembly without discrete fasteners. The insulator 306 is integrally formed of known insulating material such as the thermoplastic sold by the General Electric Company under the name Valox 420 or 750.

Figure 11B:
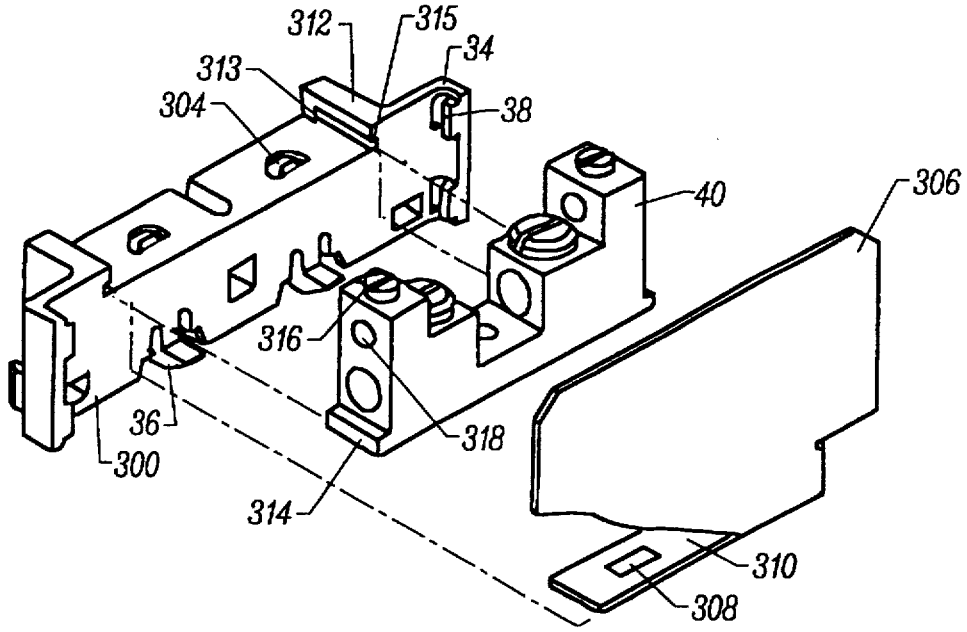
FIG. 11B is an isolated, exploded perspective view of an alternate embodiment of the neutral-interlock switch component illustrated in FIG. 11A.

Another embodiment of the neutral base 34 is illustrated in FIG. 11B to provide other examples of means for fastening the neutral base 34, electrical terminal 40, and the insulator 306 together without discrete fasteners. The neutral base 34 has a side face 300 and a top face 302. Recessed prongs 304 are integrally formed with the top face 302. The recessed prongs 304 provide means for fastening the neutral base 34 to the electrical terminal 40 and an insulator 306 with a snap-fit relationship to corresponding apertures 308 located on a right angle flange 310 formed with the insulator 306. The neutral base 34 includes a pair of offset flanges 312 located parallel to the top face 302 in an offset position sufficiently large to accommodate both the corresponding edge 314 of the electrical terminal 40 and the right angle flange 310 of the insulator. The neutral base 34 also includes the flanges 38 and prongs 36 parallel to the side face 300 and described earlier for engaging an adjacent module of the interior assembly 26.

The electrical terminal 40 is first attached to the neutral base 34 by sliding the edge 314 underneath the offset flanges 314. The insulator 306 is subsequently attached to the neutral base 34 by sliding the right angle flange 310 underneath both the electrical terminal 40 and the offset flanges 312 of the neutral base until the snap-fit relationship between the edges defining apertures 308 and the recessed prongs 304 engages. As a result, the electrical terminal 40 is also retained in positioned with the neutral base 34.

Referring now to FIGS. 2, the advantages of the modular switch assembly are readily demonstrated. The rotor coupler 48 enables the rotor 44 of the line base 32 to operate an auxiliary set of switch contacts on the seined line base by directly connecting the ends of the two rotors rather depending on the switch mechanism 30 or using a cross lever. The rotor coupler 48 also creates a rigid connection between the line base 32 and the second line base 44 to create a multi-pole interior assembly 26 greater than three poles. In fact, the present invention contemplates connecting a series of two- or three-pole line bases to customize the interior assembly to have, for example, four or six pole interior assemblies. The rotor coupler 48 also allows a retrofit expansion of an interior assembly which is already in the field since the original line base need not be disturbed to add an additional line base.

The flexibility of the present invention is demonstrated by the ability to adjust the spacing of the modules within the enclosure 12 of the switch. For example, the spacer module 42 can be used with switches manufactured by The Square D Company and identified as models H/D and G/D. Use of the spacer 42 moves the pole closest the switch mechanism, 30 over to the far wall of the enclosure to improve access to the fuse for that pole. In other models such as the QMB does not use any spacer for space adjustment. The Spacer does not affect the operation of the switch 10 since a shaft passes through the spacer 42 to connect the rotor 44 to the switch mechanism 30.

The present invention contemplates a method of assembling a plurality of individual modules to form the interior assembly of a switch. The step of the method includes manually and demountably affixing a plurality of modules to one another without discrete fasteners.

The affixing step includes upstanding a plurality of prongs from the top surface of one module. Each prong has an undercut between the top surface of the module and the end of the prong to define a retaining flange. A cut-away is integrally formed in an adjacent module in a position corresponding to engage the prong from the first module.

The compact design of the stacked fuse arrangement of the present invention allows the use of 100 amp fuses in and enclosure originally made for 60 amp fuses. Furthermore, even with the more compact design the fuses are removable with convention fuse pullers.

The present invention is preferably used with H-, R-, and J-class fuses. One of the advantages of the inventive fuse holder is the capability to use both 60-amp and 100-amp fuses without changing the dimensions of the enclosure or fuse holder. It should be understood, however, that fuses having a different rating and class can be used in the switch by modifying the dimensions of the fuse holder and the configuration of the fuse clips therein.

While particular embodiments and applications of the present applications of the present invention have been illustrated and described, it is to be understood that the invention is not limited to the precise construction disclosed herein and that various modifications, changes, and variations will be apparent to those skilled in the art may be made in the arrangement, operation, and details of construction of the invention disclosed herein without departing from the spirit and scope of the invention as defined in the appended claims.

What is claimed is:

1. A switch mechanism module for an interior assembly of an electrical distribution device having a plurality of modules, the electrical distribution device having an enclosure with a handle external to the enclosure for operator control, the switch mechanism module comprising:

a modular housing having a generally planar first base with upstanding side walls around the circumference of the first base, the side walls having a top edge defining a mating surface, the modular housing having a generally planar second base with upstanding side walls having a top edge for abutting the mating surface of the first base;

means for demountably fastening the first base to the second base, the fastening means being integrally formed with the first and second base;

a shaft having two ends, the first end being adapted to connect with the handle external to the modular housing, the second end being adapted to connect to the adjacent module of the interior assembly through the modular housing;

an operating mechanism being connected to the shaft and the first and second bases without discrete fasteners; and, means for demountably securing the housing to at least one adjacent module having a line base, the securing means being manually operated and integrally formed with the modular housing.

2. The switch mechanism module of claim 1 wherein the securing means includes a plurality of prongs integrally formed with and externally upstanding from the first base of the modular housing, each prong having an undercut between the mating surface and the end of the prong, the undercut of each prong being adapted to retain the edge of the adjacent module.

3. The switch mechanism module of claim 1 wherein the securing means includes a plurality of retaining flanges integrally formed with and externally upstanding from the first base of the modular housing, each retaining flange being adapted to retain the edge of the adjacent module.

4. The switch mechanism module of claim 1 wherein the fastening means includes:

a plurality of prongs integrally formed with and upstanding from the side walls of the first base, each prong having an undercut between the top edge of the side wall and the end of the prong; and a plurality of edges defining apertures integrally formed with the second base, the plurality of edges respectively associated with the plurality of prongs, each prong retaining the associated edge therewith so that the first and second bases are fastened together.

5. The switch mechanism module of claim 1 wherein the operating mechanism includes:

energy storage means connecting to the shaft for storing energy created by movement of the handle and subsequently releasing the energy through rotation of the shaft; and, lost motion means connecting the handle and the energy storage means to the shaft, the lost motion means providing for the movement of the handle to store energy prior to engaging the shaft and applying the stored energy to the shaft to quickly rotate the shaft.

6. The switch mechanism module defined in claim 5 wherein the energy storage means is a spring mounted on a pivot, the pivot is positioned to compress the spring until the apex of the pivot is reached and to release the spring upon passing the apex of the pivot, the pivot is rotatably connected to the modular housing without discrete fasteners.

7. The switch mechanism module defined in claim 1 wherein the shaft is rotatably secured between the mating surface of the first base and the top edge of the second base without discrete fasteners, securing means being manually operated and integrally formed with the modular housing.

8. A line base module for an interior assembly of an electrical distribution device having a plurality of modules, the electrical distribution device having a fuse for each phase in a circuit, the line base module comprising:

a modular housing having a generally planar base with upstanding side walls around the circumference of the base, the side walls having a top edge defining a mounting surface;

a terminal for connecting to one end of the circuit for each phase, the terminal being fastened to the base;

a fuse lug for connecting to the fuse on the opposite end of the circuit for each phase, the fuse lug being fastened to the base;

a switch contact for opening and closing the circuit for each phase, the switch contact connected between the terminal and the fuse lug, the switch contact being fastened to the base;

a rotor having two ends, one of the ends being adapted to connect with the adjacent module of the interior assembly, the rotor operatively connected to the switch contact of each phase, the rotor rotatably secured to the mounting surface of the side walls without discrete fasteners; and, means for demountably securing the housing to at least one adjacent module having a switch mechanism the securing means being manually operated and integrally formed with the modular housing.

9. The line base module of claim 8 wherein the securing means includes a plurality of prongs integrally formed with and externally upstanding from at least one end of the base, each prong having an undercut between the housing surface and the end of the prong, the undercut of each prong being adapted to retain the edge of the adjacent module.

10. The line base module of claim 8 wherein the securing means includes a plurality of retaining flanges integrally formed with and externally upstanding from at least one end of the base, each retaining flange being adapted to retain the edge of the adjacent module.

11. The line base module of claim 8 wherein the fuse lug for at least one phase is mounted to the base in a plane offset to the plane in which each other fuse lug mounts to the base.

12. An integrated module for a switch mechanism and line base of an interior assembly of an electrical distribution device having a plurality of modules, the electrical distribution device having an enclosure with a handle external to the enclosure for operator control and a fuse for each phase in a circuit, the integrated module comprising:

a modular housing having a generally planar first, second, and third base, the first base having upstanding side walls around the circumference of the first base, the side walls having a top edge defining a mating surface, the second base having upstanding side walls with a top edge for abutting the mating surface of the first base, the third base having upstanding side walls around the circumference of the base, the side walls of the third base having a top edge defining a mounting surface, the first and third bases having a portion of their respective side walls integrally formed together so that the first and third bases are adjacent to each other:

means for demountably fastening the first base to the second base, the fastening means being integrally formed with the first and second base;

a shaft having two ends, the first end being adapted to connect with the handle external to the modular housing;

an operating mechanism connected to the shaft and the first and second base without discrete fasteners;

a terminal for connecting to one end of the circuit for each phase, the terminal being fastened to the base;

a fuse lug for connecting to the fuse on the opposite end of the circuit for each phase, the fuse lug being fastened to the base;

a switch contact for opening and closing the circuit for each phase, the switch contact connected between the terminal and the fuse lug, the switch contact being fastened to the base; and, a rotor having two ends, one of the ends connecting with the second end of the shaft through the portion of the first and third base side walls integrally formed together; the rotor being operatively connected to the switch contact of each phase, the rotor being rotatably secured to the mounting surface of the side walls without discrete fasteners.

13. The integrated module of claim 12 wherein the integrated module further includes means for demountably securing the housing to at least one adjacent module of the interior assembly, the securing means being manually operated and integrally formed with the modular housing.

14. The integrated module of claim 13 wherein the securing means includes a plurality of prongs integrally formed with and externally upstanding from at least one end of the third base, each prong having an undercut between the housing surface and the end of the prong, the undercut of each prong being adapted to retain the edge of the adjacent module.

15. The integrated module of claim 13 wherein the securing means includes a plurality of retaining flanges integrally formed with and externally upstanding from at least one end of the third base, each retaining flange being adapted to retain the edge of the adjacent module.

16. The integrated module of claim 12 wherein the fastening means includes:

a plurality of prongs integrally formed with and upstanding from the side walls of the first base, each prong having an undercut between the top edge of the side wall and the end of the prong; and, a plurality of edges defining apertures integrally formed with the second base, the plurality of edges respectively associated with the plurality of prongs, each prong retaining the associated edge therewith so that the first and second bases are fastened together.

17. The integrated module of claim 12 wherein the operating mechanism includes:

energy storage means connecting to the shaft for storing energy created by movement of the handle and subsequently releasing the energy through rotation of the shaft; and, lost motion means connecting the handle and the energy storage means to the shaft, the lost motion means providing for the movement of the handle to store energy prior to engaging the shaft and applying the stored energy to the shaft to quickly rotate the shaft.

18. The integrated module of claim 17 wherein the energy storage means is a spring mounted on a pivot, the pivot is positioned to compress the spring until the apex of the pivot is reached and to release the spring upon passing the apex of the pivot, the pivot is rotatably connected to the modular housing without discrete fasteners.

19. The integrated module of claim 12 wherein the shaft is rotatably secured between the mating surface of the first base and the top edge of the second base without discrete fasteners.

20. The integrated module of claim 12 wherein the fuse lug for at least one phase is mounted to the base in a plane offset from the plane in which each other fuse lug mounts to the base.

* * * * *